US007128878B2

(12) United States Patent
Muser

(10) Patent No.: US 7,128,878 B2
(45) Date of Patent: Oct. 31, 2006

(54) MULTIWELL PLATE

(75) Inventor: Andrew P. Muser, Durham, NC (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 157 days.

(21) Appl. No.: 10/674,483

(22) Filed: Sep. 30, 2003

(65) Prior Publication Data

US 2004/0101948 A1 May 27, 2004

Related U.S. Application Data

(60) Provisional application No. 60/416,365, filed on Oct. 4, 2002.

(51) Int. Cl.
*B01L 3/00* (2006.01)

(52) U.S. Cl. ..... 422/102

(58) Field of Classification Search ..... 422/102
See application file for complete search history.

(56) References Cited

U.S. PATENT DOCUMENTS

| | | | | |
|---|---|---|---|---|
| 3,705,000 | A | | 12/1972 | Guerra |
| D260,428 | S | | 8/1981 | Fekete |
| D265,124 | S | | 6/1982 | Terk |
| D266,589 | S | | 10/1982 | Gilford et al. |
| 4,498,780 | A | | 2/1985 | Banno et al. |
| 4,591,556 | A | | 5/1986 | Saxholm |
| 4,797,259 | A | | 1/1989 | Matkovich et al. |
| 4,818,493 | A | | 4/1989 | Coville et al. |
| 4,828,386 | A | | 5/1989 | Matkovich et al. |
| 4,948,442 | A | | 8/1990 | Manns |
| 4,956,150 | A | | 9/1990 | Henry |
| 5,047,215 | A | | 9/1991 | Manns |
| 5,141,718 | A | | 8/1992 | Clark |
| RE34,133 | E | | 11/1992 | Thorne |
| 5,307,144 | A | | 4/1994 | Hiroshi et al. |
| 5,319,436 | A | | 6/1994 | Manns et al. |
| 5,457,527 | A | | 10/1995 | Manns et al. |
| 5,468,638 | A | | 11/1995 | Barker et al. |
| 5,487,872 | A | | 1/1996 | Hafeman et al. |
| D367,932 | S | | 3/1996 | Lim |
| 5,503,803 | A | | 4/1996 | Brown |
| 5,534,227 | A | | 7/1996 | Lahm et al. |
| 5,540,891 | A | | 7/1996 | Portmann et al. |
| 5,571,479 | A | | 11/1996 | Koch |
| 5,624,815 | A | | 4/1997 | Grant et al. |
| 5,665,558 | A | | 9/1997 | Frame et al. |
| 5,679,310 | A | | 10/1997 | Manns |
| 5,759,494 | A | * | 6/1998 | Szlosek ..... 422/102 |
| 5,792,426 | A | | 8/1998 | Portmann et al. |
| 5,795,775 | A | | 8/1998 | Lahm et al. |
| 5,801,055 | A | | 9/1998 | Henderson |
| 5,846,842 | A | | 12/1998 | Herron et al. |
| 5,858,309 | A | | 1/1999 | Mathus et al. |
| D414,271 | S | | 9/1999 | Mendoza |
| 5,962,250 | A | | 10/1999 | Gavin et al. |

(Continued)

*Primary Examiner*—Jill Warden
*Assistant Examiner*—Natalia Levkovich

(57) ABSTRACT

A well geometry for multiwell plates is provided, wherein a well is formed with an open end, a closed end and a side wall extending therebetween, the side wall including four spaced-apart rectangular panels and four rounded corners. The corners are each located to join, and extend between, a pair of adjacent panels. With rounded corners, less wicking is experienced than with flat corners designs. In addition, the rectangular panels provide relatively larger perimeters than with comparable-sized trapezoidal-shape panels as viewed in various planes cutting through the well, particularly at the bottom of the well.

15 Claims, 3 Drawing Sheets

U.S. PATENT DOCUMENTS 5,972,694 A 10/1999 Mathus
D416,330 S 11/1999 Brown
6,018,388 A 1/2000 Nawracala et al.
6,027,695 A 2/2000 Oldenburg et al.
6,033,605 A 3/2000 Szlosek
6,042,789 A 3/2000 Antonenko et al.
6,063,338 A * 5/2000 Pham et al. ..... 422/61
6,103,169 A 8/2000 Mathus et al.
6,187,033 B1 2/2001 Schmitt et al.
6,229,603 B1 5/2001 Coassin et al.
6,232,114 B1 5/2001 Coassin et al.
6,878,341 B1 * 4/2005 Kowallis et al. ..... 422/63

* cited by examiner

MULTIWELL PLATE

This application claims the benefit of U.S. Provisional Application No. 60/416,365 filed Oct. 4, 2002.

FIELD OF THE INVENTION

This invention relates to multiwell plates and, more particularly, to the well geometry of wells of multiwell plates.

BACKGROUND OF THE INVENTION

Multiwell plates are known in the prior art which are commonly used for bioassays. Each multiwell plate includes a multiwell plate body having an array of wells formed therein, typically having 96, 384, or 1,536 wells. Because of the commonplace use of multiwell plate bodies, standard dimensions of the plates have been developed to facilitate use with pick-and-place machines. Each well is cup-shaped and accommodates various chemical and/or biological fluids and matters in conducting parallel bioassays, such as with parallel drug screening.

Various well geometries are known in the prior art for use with multiwell plates. With reference to FIGS. 1–4, four prior art well geometries are depicted. FIGS. 1–3 show well geometries having rounded corners 2 interposed between trapezoidal-shaped panels 4. With these configurations, the roundness of the corners 2 is varied, as well as the relative width of the panels 4. FIG. 4 shows a well-geometry configuration of flat corners 6 interposed between rectangular panels 8.

SUMMARY OF THE INVENTION

A new and inventive well geometry for multiwell plates is provided, wherein a well is formed with an open end, a closed end and a side wall extending therebetween, the side wall including four spaced-apart rectangular panels and four rounded corners. The corners are each located to join, and extend between, a pair of adjacent panels. With rounded corners, less wicking is experienced than with flat corners designs. In addition, the rectangular panels provide relatively larger perimeters than with comparable-sized trapezoidal-shape panels as viewed in various planes cutting through the well, particularly at the bottom of the well.

These and other features of the invention will be better understood through a study of the following detailed description and accompanying drawings.

DETAILED DESCRIPTION OF THE INVENTION

Figure 1:
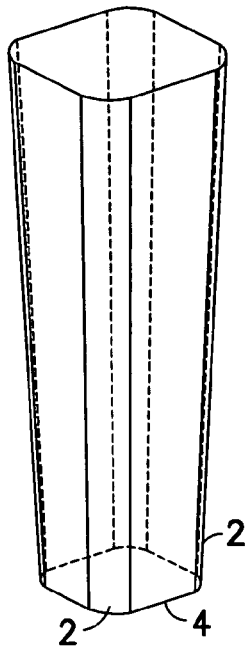
FIG. 1 PRIOR ART
FIGS. 1–4 are schematics of various prior art multiwell plate well configurations.
Figure 2:
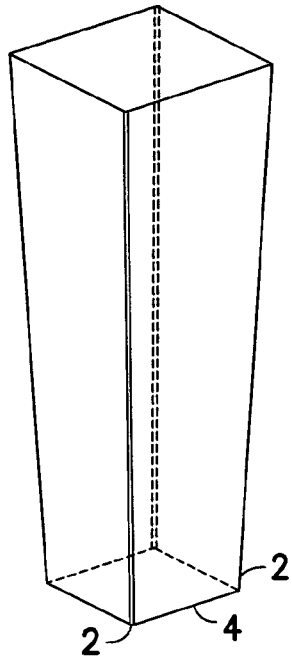
FIG. 2 PRIOR ART
Figure 3:
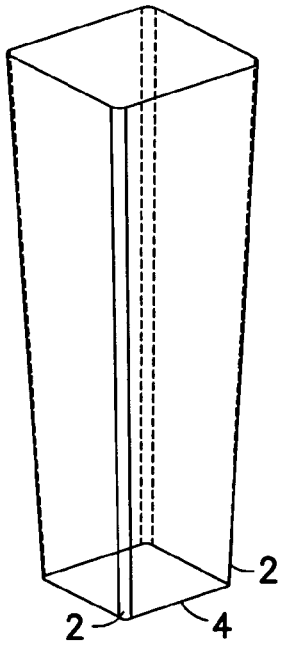
FIG. 3 PRIOR ART
Figure 4:
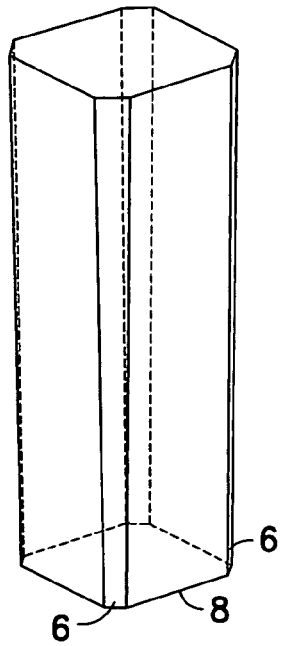
FIG. 4 PRIOR ART
Figure 5:
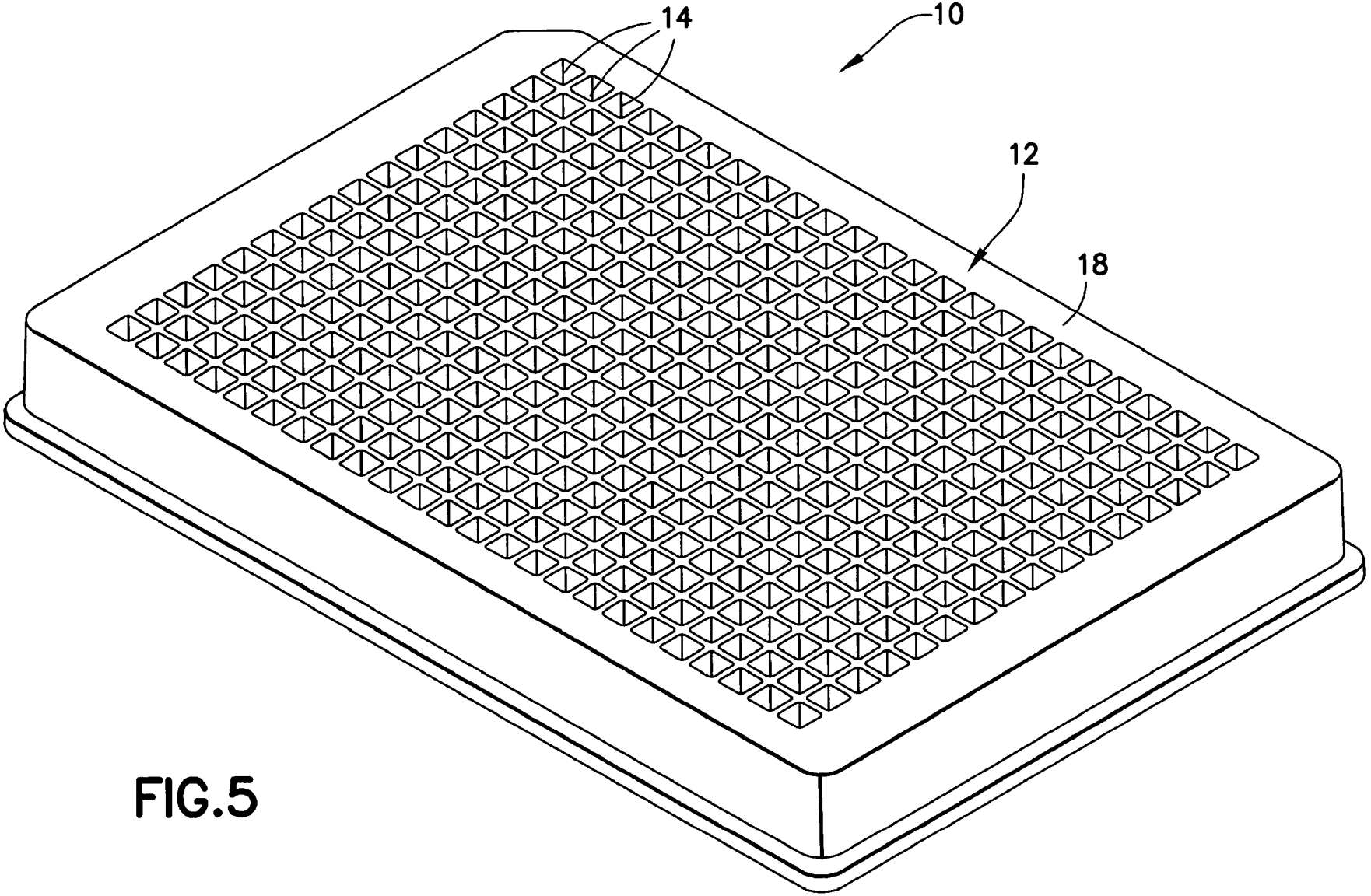
FIG. 5 is a perspective view of a multiwell plate including wells formed in accordance with the subject invention.
Figure 6:
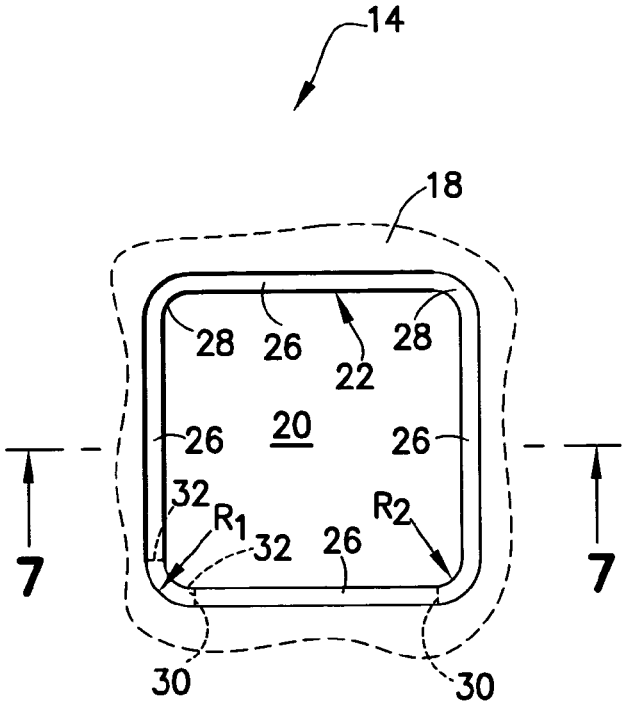
FIG. 6 is a top plan view of a well including the geometry of the subject invention; and, FIG. 7 is a cross-sectional view taken along line 7—7 of FIG. 6.
Figure 7:
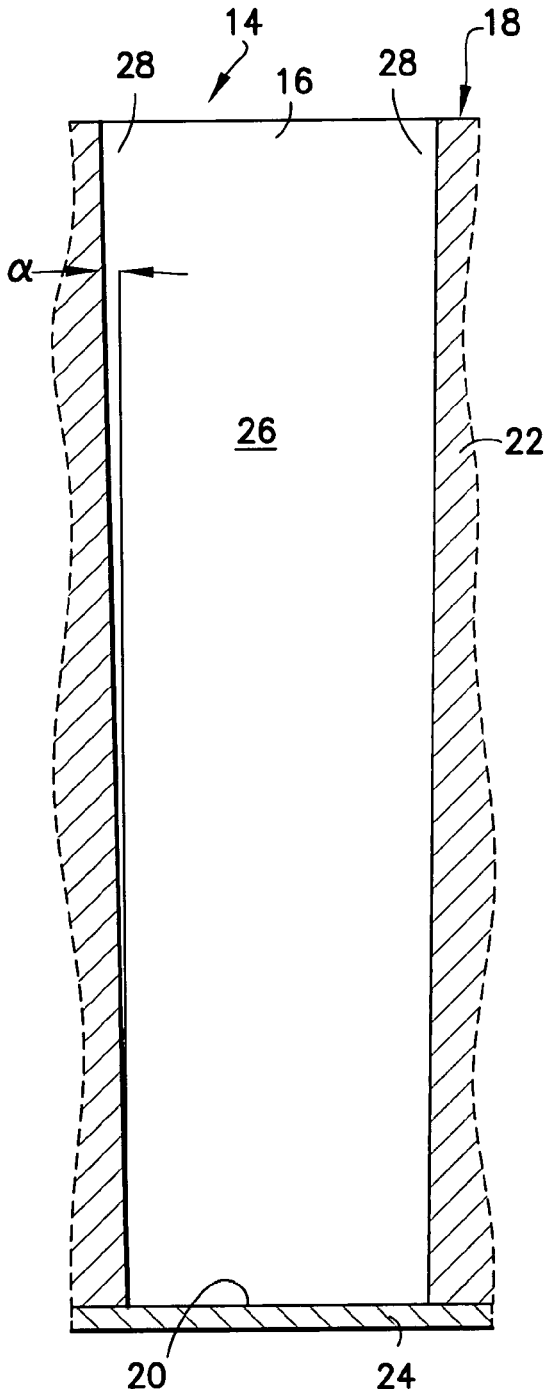

With reference to FIGS. 5–7, a new and inventive well geometry for multiwell plates is shown. The subject invention can be used in conjunction with any multiwell plate known in the art, particularly those used for bioassays. With reference to FIG. 5, a multiwell plate 10 is shown which includes a plate body 12 having a plurality of wells 14 formed therein. The wells 14 can be provided in any quantity and in any array. Commonly, multiwell plates are formed with arrays of 96, 384, or 1,536 wells. In addition, the plate body 12 can be formed to any set of dimensions, including standard dimensions which have been developed to facilitate use with pick-and-place machines. For example, the plate body 12 may be formed with a footprint defined by the standards of the Society for Biomolecular Screening (Standards SBS-1 through SBS-5). Also, any type of material may be used to form the plate body 12.

With reference to FIGS. 6 and 7, at least a portion of the wells 14 are each formed with an open end 16 extending through a top surface 18 of the plate body 12; a closed end 20; and a side wall 22 extending between the open and closed ends 16, 20. The side walls 22 are preferably formed unitarily with the plate body 12. Depending on the location of the wells 14, the side walls 22 may not only define portions of the wells 14, but also act to divide adjacent wells 14.

The closed end 20 is defined by a base 24 of the plate body 12. The base 24 may be unitarily formed with the side walls 22. Alternatively, all or a portion of the base 24 may be formed as a separate component which is joined to the side walls 22. Depending on the application of the multiwell plate 10, the side walls 22 and/or the base 24 may be formed opaque or translucent, as will be recognized by those skilled in the art.

The side wall 22 includes four spaced-apart rectangular panels 26 and four rounded corners 28. Each of the corners 28 is located to join, and extend between, a pair of adjacent panels 26. The rectangular panels 26 preferably each include a pair of side edges 30 (designated schematically in dashed lines in FIG. 6) which are generally parallel between the open and closed ends 16 and 20. The side edges 30 are depicted in the FIGS as solid lines to illustrate the invention. In practice, the side edges 30 may not be demarcated.

The wells 14 are formed preferably to converge towards the respective closed end 20 such that a smaller footprint is defined thereat than at the respective open end 16 thereof. To obtain convergence, it is preferred that the rectangular panels 26 be tapered and disposed at a tapered angle $\alpha$, and that the rounded corners 28 be tapered and formed with side edges 32 (which overlap with the side edges 30 of the rectangular panels 26) that converge towards the closed end 20. With the side edges 32 converging, the radius of the rounded corners 28 decreases from a first radius R1 at the open end 16 to a smaller second radius R2 at the closed end 20. It is preferred that the rounded corners 28 be also tapered at the taper angle $\alpha$.

By way of non-limiting example, the wells 14 may be formed with the following dimensions: a width of each of the rectangular panels 26 in the range of 2.40 mm–2.65 mm, preferably 2.65 mm (width being the distance between side edges 30); R1 in the range of 0.4 mm–0.65 mm, preferably 0.5 mm; R2 in the range of 0.05–0.30 mm, preferably 0.3 mm; and the taper angle $\alpha$ in the range of 0°–2.5°, preferably 1°.

While the invention has been described in relation to the preferred embodiments with several examples, it will be understood by those skilled in the art that various changes may be made without deviating from the spirit and scope of the invention as defined in the appended claims.

What is claimed is:

1. A multiwell plate comprising a plate body having a plurality of wells formed therein, at least a portion of said wells each being formed with an open end, a closed end and a side wall extending therebetween, said side wall including four spaced-apart rectangular panels and four rounded corners, each of said corners located to join, and extend between, a pair of adjacent said panels, wherein said corners each convergently taper towards respective said closed end.

2. A plate as in claim 1, wherein said rectangular panels taper inwardly toward respective said closed end.

3. A plate as in claim 1, wherein said plate body is unitarily formed.

4. A plate as in claim 1, wherein said closed ends of said wells are at least partially formed by a separate base portion joined to said side walls.

5. A plate as in claim 1, wherein said closed ends of said wells are at least partially formed by base portions unitarily formed with said side walls.

6. A plate as in claim 1, wherein each said rectangular panel is formed with two side edges that extend between said closed end and said open end, said side edges being generally parallel.

7. A plate as in claim 1, wherein each said corner includes two side edges that extend between said closed end and said open end, said side edges converging towards said closed end.

8. A multiwell plate comprising a plate body having a plurality of wells formed therein, at least a portion of said wells each being formed with an open end, a closed end and a side wall extending therebetween, said side wall including four spaced-apart rectangular panels and four rounded corners, each of said corners located to join, and extend between, a pair of adjacent said panels, wherein each said corner includes two side edges that extend between said closed end and said open end, said side edges converging towards said closed end.

9. A plate as in claim 8, wherein at least a portion of said wells each converge toward respective said closed end.

10. A plate as in claim 9, wherein said rectangular panels taper inwardly toward respective said closed end.

11. A plate as in claim 9, wherein said corners each convergently taper towards respective said closed end.

12. A plate as in claim 8, wherein said plate body is unitarily formed.

13. A plate as in claim 8, wherein said closed ends of said wells are at least partially formed by a separate base portion joined to said side walls.

14. A plate as in claim 8, wherein said closed ends of said wells are at least partially formed by base portions unitarily formed with said side walls.

15. A plate as in claim 8, wherein each said rectangular panel is formed with two side edges that extend between said closed end and said open end, said side edges being generally parallel.

* * * * *